US006136524A

United States Patent [19]

Verrept et al.

[11] Patent Number: 6,136,524

[45] Date of Patent: Oct. 24, 2000

[54] LIGHT-SENSITIVE EMULSION HAVING (100) TABULAR GRAINS RICH IN SILVER CHLORIDE AND METHOD FOR PREPARING SAID GRAINS

[75] Inventors: Peter Verrept, Avelgem; Ann Verbeeck, Begijnendijk; Frank Louwet, Diepenbeek, all of Belgium

[73] Assignee: Agfa-Gevaert, N.V., Mortsel, Belgium

[21] Appl. No.: 09/256,239

[22] Filed: Feb. 24, 1999

Related U.S. Application Data

[60] Provisional application No. 60/089,263, Jun. 15, 1998.

[30] Foreign Application Priority Data

Apr. 7, 1998 [EP] European Pat. Off. ..... 98201093

[51] Int. Cl.[7] ..... G03C 1/015

[52] U.S. Cl. ..... 430/569

[58] Field of Search ..... 430/567, 569, 430/637

[56] References Cited

U.S. PATENT DOCUMENTS

| | | | |
|---|---|---|---|
| 5,252,453 | 10/1993 | Tsaur et al. | 430/637 |
| 5,272,048 | 12/1993 | Kim et al. | 430/503 |
| 5,707,793 | 1/1998 | Oyamada . | |
| 5,763,151 | 6/1998 | Brust et al. | 430/569 |

FOREIGN PATENT DOCUMENTS

| | | |
|---|---|---|
| 0 518 066 A1 | 12/1992 | European Pat. Off. . |
| 0 672 940 A2 | 9/1995 | European Pat. Off. . |
| 0 672 940 A3 | 1/1997 | European Pat. Off. . |
| 0 762 192 A1 | 3/1997 | European Pat. Off. . |

*Primary Examiner*—Janet Baxter
*Assistant Examiner*—Amanda C. Walke
*Attorney, Agent, or Firm*—Breiner & Breiner

[57] ABSTRACT

A light-sensitive silver halide photographic emulsion has been described, said emulsion comprising a colloidally stabilizing binder and {100} tabular silver halide grains containing at least 50 mole % of silver chloride, wherein at least 70% by number of all grains is provided by said tabular grains, exhibiting an average aspect ratio of at least 5 and an average equivalent circular grain diameter of at least 0.3 $\mu$m, wherein said tabular grains have an average thickness of less than 0.25 $\mu$m for at least 75% by number of all tabular grains.

In order to prepare said emulsion a method has been disclosed comprising performing at least three distinct precipitation steps in an aqueous medium in a reaction vessel, followed by desalting by means of washing after flocculation or by means of ultrafiltration, wherein said three distinct precipitation steps consist of a nucleation step followed by a first and a second growth step, said method being further characterized by introducing in the said reaction vessel, after the first growth step, of a block-copolymer according to the formula (I) as described in the detailed description and in the claims.

14 Claims, No Drawings

LIGHT-SENSITIVE EMULSION HAVING (100) TABULAR GRAINS RICH IN SILVER CHLORIDE AND METHOD FOR PREPARING SAID GRAINS

The application claims the benefit of U.S. Provisional application No. 60/089,263 filed Jun. 15, 1998.

FIELD OF THE INVENTION

The present invention is related with light-sensitive {100} emulsions having {100} tabular silver halide grains rich in silver chloride, a preparation method thereof and use of said emulsions in photographic materials.

BACKGROUND OF THE INVENTION

High aspect ratio tabular grains exhibit several pronounced photographic advantages. Thanks to their particular morphology greater amounts of spectral sensitizers can be adsorbed per mole of silver halide if compared with classical globular grains. As a consequence such spectrally sensitized tabular grains show an improved speed-granularity relationship and a wide separation between their blue speed and minus blue speed. Sharpness of photographic images can be improved using tabular grains thanks to their lower light scattering properties, again if compared with conventional globular emulsion grains. In colour negative materials e.g. the conventional sequence of the light-sensitive layers can be altered and the yellow filter layer can be omitted. In developed black-and-white images high covering power is obtained even at high hardening levels. Alternatively reduced silver halide coverages can be achieved if desired, which again results in improved sharpness. In duplitized radiographic materials the presence of tabular grains reduces the so-called cross-over which is the main factor for sharpness in such materials. Moreover coating amounts of silver can be reduced, further in favour of production cost and ecology.

An emulsion is generally understood to be a "tabular grain emulsion" when tabular grains account for at least 50 percent of the total grain projected area. A grain is generally considered to be a tabular grain when the ratio of its equivalent circular diameter to its thickness is at least 1.5. The equivalent circular diameter of a grain is the diameter of a circle having an area equal to the projected area of the grain.

Early patent disclosures on high aspect tabular grains, e.g. U.S. Pat. Nos. 4,434,226; 4,439,520; 4,425,425; 4,425,426; 4,433,048 and Research Disclosure, Vol. 225, Jan. 1983, Item 22534, are concerned with high sensitive silver bromide or silver iodobromide {111} tabular grain emulsions. In a lot of photographic applications however high sensitivity is less important. In these cases the use of emulsions rich in chloride is advantageous thanks to their higher development and fixing rates favourable in rapid processing applications. Typical examples include graphic arts contact materials, duplicating materials, hard-copy materials, diffusion transfer reversal materials and black-and-white or colour print materials. However when combined, high sensitivity and rapid processing applicability are highly appreciated. So it remains interesting to combine the advantages of emulsions rich in chloride with the advantages of a tabular grain structure.

Silver halide tabular grains rich in chloride can have parallel faces in the {111} crystal plane or in the {100} crystal plane, thus providing a tabular {111} or a tabular {100} habit respectively.

In earlier disclosures most attention was paid to the preparation of tabular grains rich in chloride having a {111} crystal habit as in U.S. Pat. Nos. 4,400,463; 4,713,323; 4,804,621; 5,183,732; 5,185,239; 5,178,998; 5,178,997 and in EP-A 0 481 133.

The first publications on tabular grains bounded by {100} parallel major faces were related with silver iodobromide emulsions. Bogg in U.S. Pat. No. 4,063,951 and Mignot in U.S. Pat. No. 4,386,156 were the most important publications.

In EP-A 0 534 395 Brust et al. disclose the first {100} tabular emulsion grains rich in chloride and a process for preparing them wherein the tabular grain fraction showing {100} major faces is significant. Further improvements and variations on the teachings of the said tabular {100} emulsions rich in chloride have been described in U.S. Pat. Nos. 5,024,931; 5,264,337; 5,275,930; 5,292,632; 5,310,635; 5,314,798; 5,320,938; 5,356,764; 5,601,967; in WO-Applications 94/22051 and 94/22054 and in EP-A's 0 569 971; 0 584 815; 0 584 644; 0 602 878; 0 616 255; 0 617 317; 0 617 320; 0 617 321; 0 617 325; 0 618 492; 0 618 493; 0 653 659 and 0 653 669.

In conventional photographic materials for radiographic recording high-sensitive silver (iodo)bromide tabular emulsions are currently used. However with respect to recent trends to rapid processing applications it is desirable to use silver halide emulsions rich in chloride as the said emulsions show a faster developability as has e.g. been disclosed in EP-A 0 678 772.

One of the major problems arising in the preparation methods of {111} tabular grains rich in chloride is the problem of crystallographic stability, which after making use of a crystal habit modifier in the preparation step of the said grains requires the cumbersome step of replacing the said habit modifier by other compounds adsorbed at the large crystal surface as has e.g. been demonstrated in U.S. Pat. No. 5,221,602. Due to the steps of adsorbing, desorbing and replacing different adsorbing compounds the reproducibility and stability of the grains is questionable.

As has been shown e.g. in EP-A 0 653 669 during the preparation of {100} tabular grains rich in chloride the presence of such an adsorbed crystal habit modifier is not required as an excellent crystallographic stability is obtained. Moreover an improved reproducibility of sensitometric characteristics, if compared with equivalent {111} tabular silver halide emulsion crystals can be expected.

As it has always been important to get a percentage of tabular grains as high as possible within the whole emulsion crystal population, in favour of all properties offered by the said tabular grains, it is clear that every improvement in that direction is highly appreciated. An attempt to reach that object, particularly for high chloride {100} tabular grains comprising iodide ions, has been described in U.S. Pat. No. 5,413,904, wherein it has been proposed as an indispensable asset to delay the introduction of iodide ions in the reaction vessel until after grain nucleation has occurred.

As moreover tabular grains having higher aspect ratios and a reduced thickness are more favourable with respect to the amount of coated silver halide required in order to get the same covering power, speed and gradation within a shorter processing time if compared with thicker crystals having a lower aspect ratio, such thinner crystals having higher aspect ratios are highly preferred.

Moreover reduction of the presence besides the desired {100} tabular grains of grains having a habit deviating from the desired one as e.g. cubic grains or substantially cubic grains (having an aspect ratio of less than 1.5), needles (having a ratio of long edge length L to short edge length 1 of the cylinder of more than 10) and single twins (cubic {100} crystal having 1 single twin plane along <111>, <311> or <411> plane) is desired as well in favour of homogeneity of crystal habit.

The present invention thus further extends the teachings on tabular emulsions grains (or crystals) rich in silver chloride having a {100} crystal habit (having a ratio of long edge length L to short edge length 1 of the rectangle of not more than 10 and, more preferably not more than 5), more particularly teachings with respect to grains having an average aspect ratio of more than 5, an average equivalent grain or crystal diameter of at least 0.3 μm and a thickness of less than 0.25 μm.

OBJECTS AND SUMMARY OF THE INVENTION

It is an object of the present invention to provide an emulsion having light-sensitive silver halide tabular grains rich in silver chloride and a method of preparing those grains having {100} major faces, an average aspect ratio of more than 5 and an average equivalent circular grain diameter of at least 0.3 μm, wherein the procentual ratio by number of {100} tabular grains having a thickness of less than 0.25 μm to {100} tabular grains thicker than 0.25 μm in that emulsion is remarkably enhanced.

It is a further object to reduce the procentual number of grains other than {100} tabular grains.

Other objects of the invention will become clear from the description hereinafter.

The objects of the present invention are realized by a light-sensitive silver halide photographic emulsion comprising a colloidally stabilizing binder and {100} tabular silver halide grains containing at least 50 mole % of silver chloride, wherein at least 70% by number of all grains is provided by said tabular grains, exhibiting an average aspect ratio of at least 5 and an average equivalent circular grain diameter of at least 0.3 μm, wherein said tabular grains have an average thickness of less than 0.25 μm for at least 75% by number of all tabular grains.

In order to prepare said emulsion a method has been provided comprising performing at least three distinct precipitation steps in an aqueous medium in a reaction vessel, followed by desalting by means of washing after flocculation or by means of ultrafiltration, wherein said three distinct precipitation steps consist of a nucleation step followed by a first and a second growth step, said method being further characterized by introducing in the said reaction vessel, after the first growth step (and preferably before the second growth step), a block-copolymer according to the formula (I) as described hereinafter and in the claims.

The emulsion as claimed thus also comprises a block-copolymer according to the said formula (I)

(I)

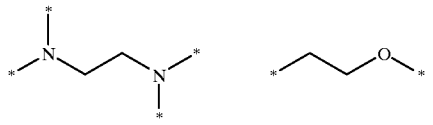

-continued

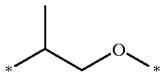

wherein said block-copolymer consists of hydrophilic polyoxyethylene units in an amount by number of at least three and hydrophobic polyoxypropylene block units in an amount by number of not more than one and ethylenediamine as tetravalent linking unit.

DETAILED DESCRIPTION OF THE INVENTION

As an essential feature precipitating in at least three distinct precipitation steps in the reaction vessel is mentioned. Said three distinct precipitation steps are, consecutively:

1. a nucleation step, wherein from 1 to 20%, more preferably from 5 to 15%, of the total available amount of silver nitrate is provided and wherein silver ions and halide ions are introduced at a flow rate in order to get cubic nuclei rich in silver chloride having a crystal edge of at most 0.25 μm. Therefore an approximately equimolecular addition is performed of silver salts and halide salts, preferably pure silver chloride salts, optionally having at most up to 5 mole % of bromide and/or at most up to 0.5 mole % of iodide (more preferably from 0.05 up to 0.3 mole % and even more preferably substantially free from iodide). The flow rate of the solutions is chosen in such a way as to get a crystal edge side, determining the thickness of the {100} tabular grains rich in silver chloride resulting therefrom. In a preferred embodiment said crystal edge is from 0.05 μm up to 0.25 μm, more preferably from 0.05 μm up to about 0.20 μm.
2. a first growth step wherein an increasing flow rate of silver salt and halide salt solutions, preferably having a composition as in the nucleation step but which may be differing therefrom, is preferably performed by a linearly increasing flow rate, particularly after running said silver and halide solutions in the reaction vessel at a constant flow rate for at least half of the total nucleation time. Typically the flow rate at the end of this first growth step is about up to 5 times greater than at the start of the growth step, more preferably between 1 to 3 times and still more preferably between once and twice the starting flow rate;
3. a second growth step wherein a further increasing flow rate of silver and halide solutions, preferably having a composition as in the first growth step but which may be differing therefrom, is preferably performed by a linearly increasing flow rate. Typically the flow rate at the end of this second growth step is up to 10 times greater than at the start of the growth step, more preferably between 1 to 5 times and still more preferably between 1 and 3 times.

In the first as well as in the second growth step these flow rates can be monitored by e.g. magnetic valves. During the growth step(s) the pAg is preferably maintained at a constant value, made optionally variable in order to provide growth without further nucleation.

According to the present invention the method wherein the three distinct precipitation steps are present is characterized by introducing in the said reaction vessel, after the first growth step (and more preferably before the second growth step) a block-copolymer according to the formula (I), wherein said block-copolymer contains, besides an ethylenediamine unit as tetravalent linking unit, at least three terminal hydrophilic polyoxyethylene groups and not more than one terminal hydrophobic polyoxypropylene block unit.

A representative block-copolymer according to the formula (I) is the commercially available copolymer TETRONIC 1508® of BASF, Ludwigshafen, Germany.

In a preferred embodiment of the method of the present invention introducing the block-copolymer in the reaction vessel proceeds after the first growth step and before the second growth step.

In the said reaction vessel the pH is preferably established at a value of between 2.0 and 10.0 and more preferably between 3.0 and 9.0. In order to provide homogeneity so that at least 70% by number, more preferably at least 80% and still more preferably at least 90% by number of the formed grains are {100} tabular crystals, it is of utmost importance to avoid additional formation of new nuclei during both growth steps.

Apart from the three distinct growth steps, in order to attain the desired {100} tabular grains rich in silver chloride, having at least 50 mole % of silver chloride, more preferably at least 70 mole % and still more preferably, more than 90 mole %, said tabular grains exhibiting an average aspect ratio of at least 5 and an average equivalent circular grain diameter of at least 0.3 μm, and moreover an average thickness of less than 0.25 μm for at least 75% by number of all tabular grains, it is an essential feature to have, between the nucleation step and the first growth step, a crystal dislocation step wherein one or more dislocations is(are) introduced onto the nuclei formed in the nucleation step.

This step, described in EP-Application No. 97203311, filed Oct. 24, 1997, can be performed by making use therefore of introducing in the reaction vessel at least one compound providing ions selected from the group consisting of iodide ions, bromide ions, complex anions as $CN^-$, $SCN^-$, $SeCN^-$, etc. and complex metal ions satisfying formula (II)

$$[M\,L_6]^{n-} \qquad \text{(II)}$$

wherein M represents an element from group VIII in the periodic system of the elements (Table of Mendelejew), preferably being $Ru^{2+}$, $Os^{2+}$, $Rh^{3+}$, $Ir^{3+}$ or $Pt^{2+}$;

$L_6$ represents six coordination complex ligands which are independently selected, provided that at least three of the said ligands are more electronegative than any halide ligand and at least four of the said ligands are anionic ligands, e.g. $CN^-$, $SCN^-$, $SeCN^-$, etc; and n=1, 2, 3 or 4.

Introduction of dislocation lines in crystals making use of metal dopants has e.g. been described in JP-A's 07-712778, 07-219097, 07-219097, 07-128769, 07-159913 and 8-171159.

Preferred group VIII metal ions used in order to introduce a crystal dislocation onto the nuclei formed are e.g. $Ru^{2+}$, $Os^{2+}$, $Rh^{3+}$, $Ir^{3+}$ or $Pt^{2+}$. Especially preferred are complex ion compounds of ruthenium, and more preferably hexacyano-ruthenium salts.

Group VIII metal ions useful in the method of the present invention, the addition of which is not specifically restricted to addition during nucleation in silver halide crystals, have e.g. been described in U.S. Pat. Nos. 4,981,781 (Ru,Fe,Rh, Os); 5,024,931 (Ru,Rh,Os,Ir, Pd,Pt); 5,252,456 (Pt,Ir) and 5,360,712 and EP-A's 0 336 426 (Ru,Os);
0 336 427 (Ru,Os); 0 415 481 (Rh,Ir,Os,Ru,Fe,Co)and 0 762 192 (Ir) and in Research Disclosure No. 38957, Chapter I, D(3), published Sep. 1, 1996. More recent simultaneous filings, dated Jan. 30, 1998, are EP-Applications Nos. 98200280 and 98200281.

Most frequently occurring dopants in literature are ruthenium, rhodium and iridium. Combinations of one or more dopant(s) may be added, in the same or different preparation steps of the {100} tabular silver halide crystals rich in silver chloride.

When use is made of iodide ions and/or bromide ions, these ions may be provided by means of an organic iodide or bromide releasing agent. Such releasing agents have e.g. been described in U.S. Pat. Nos. 5 5,389,508; 5,482,826; 5,498,516; 5,524,660 and 5,527,664; and in EP-A 0 651 284. Alternative techniques in order to create dislocations are however not excluded.

Crystal dislocation(s) in the nuclei performed by the method of the present invention are introduced in order to provide anisotropic growth of the said nuclei into {100} tabular grains. In order to get the desired crystal diameter of at least 0.3 μm it is important to introduce crystal dislocations in a time no longer than the time required to perform a first physical ripening step after the nucleation step, in order to get a number of dislocation lines of less than 5, more preferably of less than 3, thus corresponding with a number of 1 or 2 of the said dislocation lines, wherein it is of utmost importance that said dislocation lines are lying in one and the same crystallographic plane in order to get two-dimensional growth, thus avoiding thickness growth. Said physical ripening step following introducing said dislocation line or lines and growing the nuclei formed in the nucleation step during the first growth step immediately following said physical ripening step is preferably within a time interval from 2 to 30 minutes, more preferably from 2 to 10 minutes.

Introducing crystal dislocations as set forth has a minor influence on crystal thickness as long as low amounts of e.g. iodide ions are added. Opposite thereto higher amounts introduce more dislocation lines and/or dislocation lines that are not lying in one and the same crystallographic plane during growth of the formed nuclei, thereby causing three-dimensional (thickness) growth.

Introducing crystal dislocations, thereby generating dislocation lines situated in one and the same crystallographic plane is thus important order to get no thickness growth and in order to provide the desired equivalent circular diameter (ECD) of the {100} tabular crystals rich in silver chloride as a function of amounts of silver nitrate added to the vessel during the two growth steps making part of the three distinct precipitation steps according to the method of the present invention.

Whereas nucleation is thus mainly determining the thickness of the tabular {100} silver halide grains, being less than 0.25 μm for at least 75% by number of all tabular grains as set forth in the present invention, the first growth step is required in order to increase the "Ostwald ripening pressure" between "non-dislocated" and "dislocated" grains in order to stimulate Ostwald (physical) ripening during the physical ripening time between the first and the second growth step, in order to make disappear the "non-dislocated" grains.
In the presence in the reaction vessel of the block-copolymer according to the formula (I) before starting nucleation more thickness growth can be expected, with a more homogeneous crystal distribution as a consequence of the presence of lower amounts of grains having an equivalent volume diameter of less than 0.03 μm.

During the second physical ripening step Ostwald ripening makes further disappear fine crystals, thereby causing an increased homogeneity in equivalent circular crystal diameter at the end of the preparation.

It is further not excluded to introduce further physical ripening steps and/or growth steps. At the end of the precipitation it is moreover possible to introduce halide ions or complex anions forming a less soluble silver salt than the silver salt present at the surface of the formed {100} tabular grains rich in silver chloride. In that way surface conversion by e.g. iodide in form of iodide ions or in form of a fine silver iodide micrate emulsion grains (also called "Lippmann emulsions") having a crystal diameter of not more than 0.050 μm in amounts favourable in order to enhance spectral sensitization properties and/or to decrease pressure sensitivity is highly appreciated.

Before and during formation of the silver halide nuclei rich in silver chloride, preferably being pure silver chloride, it is common practice to establish a concentration of colloidally stabilizing binder in amount from about 0.05%, more preferably from about 1% and still more preferably from 5–10% up to 100% by weight of the total available amount of stabilizing binder in the dispersion medium in the reaction vessel before or during nucleation.

According to the method of the present invention the binder used is a compound selected from the group consisting of gelatin, the block-copolymer corresponding to the formula (I) and colloidal silica or a combination thereof. Gelatin is nearly always present, except when colloidal silica is e.g. present as a sole colloid besides the block-copolymer corresponding to the formula (I). In that case the presence of onium compounds, more preferably phosphonium compounds, is highly preferred as has e.g. been disclosed in EP-A 0 677 773.

Use of colloidal silica in the preparation of {100} tabular grains has been described in EP-A 0 767 400.

According to the method of the present invention, in the presence of gelatin as a colloidally stabilizing binder, gelatin having a methionine content of at most 4000 ppm (so-called "oxidized" gelatin) is preferred and it is even more preferred to use gelatin having a calcium content of less than 40 ppm (so-called "calcium-free" gelatin). Said "oxidized" gelatin thus has a methionine content of at most 4000 ppm, but in a more preferred embodiment said gelatin is oxidized to a degree in order to have a methionine content of at most 1500 ppm. Gelatin being substantially free from calcium ions is also called "deionized" gelatin. Additional information about those specific kinds of gelatin have been dealt with in EP-A 0 843 207.

After completion of precipitation step, eventually followed by a further conversion and/or physical ripening step, a wash technique in order to remove the excess of soluble salts is applied. Any conventional wash technique can be used e.g. washing with several water portions after flocculation by an inorganic salt or by a polymeric flocculating agent like polystyrene sulphonic acid. Emulsion washing has e.g. been described in Research Disclosure No. 38957 (1996), Chapter III. In a preferred embodiment ultrafiltration is used as wash technique. Such procedure has been disclosed e.g. in Research Disclosure, Vol. 102, Oct. 1972, Item 10208; in Research Disclosure Vol. 131, March, Item 13122 and in Mignot U.S. Pat. No. 4,334,012.

The emulsion prepared according to the method of the present invention thus comprises {100} tabular silver halide grains containing at least 50 mole % of silver chloride, more preferably at least 70 mole % of silver chloride and still more preferably at least 90 mole % of silver chloride.

Additional gelatin, colloidal silica and/or block-copolymer according to the formula (I) may be added in a later stage of the emulsion preparation e.g. after washing, in order to establish optimal coating conditions and/or in order to establish the required thickness of the coated emulsion layer. That gelatin can be conventional (calcium containing, thus not demineralized) non-oxidized gelatin, having high amounts of methionine, but calcium free and/or oxidized gelatin is not excluded. Preferably a ratio by weight of gelatin to silver halide ranging from 0.2 to 1.0 is then obtained, wherein silver halide is expressed as an equivalent amount of silver nitrate.

In the said emulsion at least 70% by number, more preferably at least 75% and still more preferably at least 90% by number of all grains is provided by said tabular grains having an average equivalent circular grain diameter of at least 0.3 μm, e.g. from 0.3 μm up to 10 μm, preferably from 0.7 μm up to 5 μm and even more preferably from 0.7 up to 2.5 μm., wherein said tabular grains exhibit an average aspect ratio of at least 5, more preferably from 5 to 50 and still more preferably from 5 to 25; an average thickness of less than 0.25 μm for at least 75% by number of all tabular grains present, preferably from 0.05 up to 0.20 μm.

As tabular grains rich in chloride having a {100} crystal habit as in the present invention do not require use of a crystal habit modifier during the emulsion preparation as is the case during preparation of {111} tabular grains, this is particularly in favour of reproducibility.

In a preferred embodiment the emulsion prepared according to the method of the present invention is an emulsion comprising {100} tabulair silver chloroiodide grains. In particular the iodide ions used therein are located at the surface of the {100} grains as a result of a iodide conversion step at the end of the preparation, thereby making the silver iodide concentration increase in the vicinity of the crystal surface and reaching the highest concentration at the crystal surface.

It is specifically contemplated that up to at most 3 mole % of iodide ions are incorporated in the said silver chloroiodide grains by the method as described hereinbefore. This is in one embodiment achieved by mixing a soluble chloride and a soluble iodide salt, like potassium iodide, in one or more of the halide solutions up to the desired mole % concentrations required in each preparation step or by a triple jet technique with separate addition of an iodide containing aqueous solution. Due to the about $10^6$ times lower solubility of silver iodide ions in comparison with silver chloride, said iodide ions are able to displace chloride ions from the grain, a technique known in the art as conversion. Iodide ions are in another embodiment incorporated into the silver halide crystal lattice by the addition of a previously prepared silver iodide micrate emulsion, also called Lippmann emulsion, composed of either pure silver iodide or mixed halides, but in a preferred embodiment iodide is provided by means of an iodide releasing agent. Patent applications referring to methods wherein iodide releasing agents are used are e.g.

EP-A's 0 563 701, 0 563 708, 0 561 415 and 0 651 284. Even bromide releasing agents are not excluded in the precipitation steps according to the method of the present invention if bromide ions are incorporated in the {100} tabular grains rich in chloride prepared according to the method of the present invention.

Tabular silver halide emulsions comprising tabular {100} grains rich in silver chloride prepared by the method of the present invention can be chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H.

Frieser and published by Akademische Verlagsgesellschaft (1968). As described in said literature chemical sensitization can be carried out by effecting the ripening in the presence of small amounts of compounds containing sulfur e.g. thiosulphate, thiocyanate, thioureas, its selenium or its tellurium analogues, sulfites, mercapto compounds, and rhodamines. The emulsions can be sensitized also by means of gold-sulfur ripeners, or gold-selenium ripeners, or gold-sulphur-selenium ripeners, wherein in addition of or instead of selenium ripeners tellurium compounds may be added, or by means of reductors e.g. tin compounds as described in GB-Patent 789,823, amines, hydrazine derivatives, formamidine sulfinic acids, toluene thiosulfonic acid and silane compounds. A general review of chemical sensitization can be found in Research Disclosure No. 38957, Chapter IV, published Sep. 1, 1996. Specifically useful selenium sensitizers have been described e.g. in EP-A 0 476 345 and in EP-Applications Nos. 96202612, filed Sep. 18, 1996 and 97200590, filed Mar. 1, 1997. Selenium and/or tellurium sensitizers have been described in U.S. Pat. No. 5,654,134.

The silver halide emulsions under consideration can be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in Research Disclosure No. 38957 mentioned hereinbefore, Chapter Va.

Oxacarbocyanines have been described e.g. in U.S. Pat. No. 5,434,042. Especially preferred green sensitizers in connection with the present invention are anhydro-5,5'-dichloro-3,3'-bis(n.sulfobutyl)-9-ethyl-oxacarbocyanine hydroxide and anhydro-5,5'-dichloro-3,3 '-bis(n.sulfo-propyl)-9-ethyl-oxacarbocyanine hydroxide. Imidacarbocyanines as e.g. those described in Research Disclosure No. 37312 (1995) may be useful as well as combinations of oxacarbocyanines and imidacarbocyanines as in EP-A 0 590 593 from the viewpoint of sensitivity as well as from the viewpoint of decolouring properties and stain removal in the processing of materials containing spectrally sensitized tabular grains. Descriptions of combinations of oxacarbocyanine and imidacarbocyanine dyes van further be found in U.S. Pat. Nos. 3,397,060; 3,814,609; 3,865,598; 3,864,134; 5,597,687; 5,296,345; 5,338,655 and 5,541,047 as well as in DE-A 2 734 335, in EP-A 0 608 955 and in EP-Application No. 98200061, filed Jan. 13, 1998.

A suitable mixture of oxacarbocyanine and imidacarbocyanine spectral sensitizers that is applied in favour of decolouring properties and sensitometry is e.g. anhydro-5,5'-dichloro-3,3'-bis (n-sulfobutyl)-9-ethyl oxacarbocyanine hydroxide or anhydro-5,5'-dichloro-3,3'-bis(n-sulfopropyl)-9-ethyl-oxacarbocyanine hydroxide together with anhydro-5,5'-dicyano-1,1'-diethyl-3,3'-di(2-acetoxy-ethyl)ethyl-imidacarbocyanine bromide.

In classical emulsion preparation spectral sensitization traditionally follows the completion of chemical sensitization. However, in connection with tabular grains, it is specifically considered that spectral sensitization can occur simultaneously with or even precede completely the chemical sensitization step. In the preferred embodiment wherein the tabular {100} emulsion is a chloroiodide emulsion the spectral sensitizers are preferably added even before digestion of an ultrafiltrated emulsion or redispersion of a flocculated and washed emulsion: chemical sensitization after spectral sensitization is believed to occur at one or more ordered discrete sites of the tabular grains. In praxis chemical sensitization may e.g. proceed in the presence of one or more phenidone and derivatives, a dihydroxy benzene as hydroquinone, resorcinol, catechol and/or a derivative(s) therefrom as e.g. sulfodihydroxy aryl compounds described in EP-A 0 718 682, one or more stabilizer(s) or antifoggant (s), one or more spectral sensitizer(s) or combinations of said ingredients. Especially 1-p-carboxy-phenyl, 4,4' dimethyl-pyrazolidine-3-one may be added as a preferred auxiliary agent as disclosed in U.S. Pat. No. 5,447,826.

The gelatinous emulsion rich in silver chloride prepared according to the method of the present invention, is further coated in hydrophilic layer(s) which may, just as non-light-sensitive layers of the photographic material according to this invention, comprise compounds preventing the formation of fog or stabilizing the photographic characteristics during production or storage of the photographic elements or during the photographic treatment thereof.

Many known compounds can be added as fog-inhibiting agent or stabilizer to the silver halide emulsion layer or to other coating layers in water-permeable relationship therewith such as an undercoat or a protective layer (as has been described e.g. in EP-A 0 528 480 wherein a 3-pyrazolidone compound is used). Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotria-zoles, mercaptotriazoles, mercaptotetrazoles, in particular 1-phenyl-5-mercaptotetrazole and acetamido-1-phenyl-5-mercaptotetrazole, mercaptopyrimidines, mercaptotriazines, mercaptoimidazoles, mercapto-thiadiazoles, mercapto-oxadiazoles, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-Patents 1,203,757 and 1,209,146, in JP-A 7539537, and GB-Patent 1,500,278, and 7-hydroxy-s-triazolo-[1,5-a]-pyrimidines as described in U.S. Pat. No. 4,727,017, and other compounds such as benzenethiosulfonic acid, benzenethiosulfinic acid and benzenethiosulfonic acid amide, and sulfodihydroxy aryl compounds as in U.S. Pat. Nos. 5,491,055 and 5,631,126. Other compounds that can be used as fog-inhibiting compounds have been described in Research Disclosure No. 17643 (1978), Chapter VI and in RD No. 38957 (1996), Chapter VII. Another survey specifically with respect to {100} tabular grains has been given in EP-A 0 617 320. Many of these fog-inhibiting compounds may have been already added during the chemical ripening of the {100} tabular silver halide crystals rich in silver chloride as already set forth hereinbefore.

It is clear that additional gelatin may be added in a later stage of the emulsion preparation, e.g. after washing, in order to establish optimal coating conditions and/or in order to establish the required thickness of the coated emulsion layer. Preferably a gelatin to silver halide ratio ranging from 0.2 to 1.0 is then obtained, wherein extra gelatin added is not required to have a composition as specific as in the preparation step of the grains according to the method of the present invention. Another binder may also be added instead of or in addition to gelatin. Useful vehicles, vehicle extenders, vehicle-like addenda and vehicle related addenda have been described e.g. in Research Disclosure No. 38957 (1996), Chapter II.

The gelatin binder of the photographic material having at least one gelatinous emulsion according to the present invention can be forehardened with appropriate hardening agents such as those of the epoxide type, those of the ethylenimine type, those of the vinylsulfone type e.g. 1,3-vinylsulphonyl-2-propanol, bis-vinyl-sulfonyl-methane or ethane and those substituted with hydroxyl groups in order to provide a better solubility in aqueous medium, chromium salts e.g. chromium acetate and chromium alum, aldehydes e.g. formaldehyde, glyoxal, and glutaraldehyde, N-methylol compounds e.g. dimethylol-urea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds disclosed in EP-A 0 408 143.

A review of hardening agents useful to harden the hydrophilic layers of the material comprising one or more {100} tabular silver halide grains rich in silver chloride, prepared according to the present invention can be found e.g. in RD 38957, Chapter IIb.

In a preferred embodiment the hydrophilic layer package of silver halide photographic materials comprising in one or more light-sensitive layers one or more {100} tabular silver halide emulsions rich in silver chloride crystals prepared according to the method of the present invention, has a swelling degree of not more than 200%. Said swelling degree is determined by means of the following procedure: a sample of the coated material is incubated at 57° C. and 34% RH for 3 days, whereafter the thickness (a) of the layer assemblage is measured. Thereafter the sample is immersed in distilled water at 21° C. for 3 minutes and the thickness (b) of the swollen layer is measured.

The swelling ratio is then calculated as: $(b-a)/a\times100$ (%). Another expression telling the same is that per gram of gelatin coated, not more than 2 g of distilled or demineralized water at 21° C. is absorbed within 3 minutes.

The gelatinous emulsions comprising {100} tabular grains rich in silver chloride of the present invention can be used in various types of photographic elements e.g. black-and-white silver halide photographic materials, like materials used for X-ray diagnostic purposes and microfilms, or colour sensitive materials.

Two or more types of tabular silver halide emulsions that have been prepared in the same way but which may have been prepared differently can be mixed for forming a photographic emulsion for use in photographic materials in accordance with the present invention.

In a preferred embodiment the photographic material is a photographic material comprising a support and at least one light-sensitive silver halide emulsion layer on at least one side of said support, wherein said emulsion layer(s) comprise(s) one or more emulsions containing {100} tabular silver halide emulsion grains prepared according to the method of the present invention. In a further preferred embodiment said photographic material is a single or double side coated X-ray material.

The single-side coated X-ray material may contain one single emulsion layer, as it is the case for many applications, or it can be built up by two or even more emulsion layers. In X-ray photography a material with a single or a duplitized emulsion layer coated on one or both sides of the support thus contains at least one gelatinous silver halide emulsion according to the invention.

By using duplitized emulsions differing in photographic speed by at least 0.15 log E a gain in cross-over exposure in double side coated materials can be obtained. In the case of colour photography the material contains blue, green and red sensitive layers each of which can be single coated as in most common colour positive materials, but may consist of double or even triple layers as in colour negative or colour intermediate applications.

In a preferred embodiment according to the present invention said photographic material comprises at least two layers having negative image type silver halide emulsions adjacent to each other, wherein the emulsion layer more close to the support comprises at least one emulsion having tabular emulsion crystals selected from the group consisting of silver chloride, silver chlorobromide, silver chloroiodide and silver chlorobromoiodide having a {100} crystal habit, prepared according to the method as described hereinbefore, wherein the adjacent layer(s) farther from the support comprise(s) at least one emulsion having essentially cubic emulsion crystals selected from the group consisting of silver chloride, silver chlorobromide, silver chloriodide, silver chlorobromoiodide, silver bromide.and silver bromoiodide. This layer arrangement e.g. is particularly in favour of pressure insensitivity, but is also useful in order to improve image tone. Other measures to improve image tone which may be used have e.g. been given in EP-A 0 789 266 wherein leuco-dyes are described, forming a dye by reaction with oxidized developer in the vicinity of the developed grains. Leuco-dyes have already earlier been described for this purpose in U.S. Pat. No. 4,865,958.

Besides the light sensitive emulsion layer(s) the photographic material may contain several light-insensitive layers, e.g. a protective layer, one or more backing layers, one or more subbing layers, one or more intermediate layers e.g. filter layers and even an afterlayer containing e.g. the hardening agent(s), the antistatic agent(s), filter dyes for safety-light purposes, etc.. The photographic element of the present invention may further comprise various kinds of coating physical property modifying addenda as described in RD No. 38957 (1996), Chapter IX, wherein coating aids, plasticizers and lubricants, antistats and matting agents have been described. Development acceleration can be accomplished by incorporating in the emulsion layer or adjacent layers various compounds, preferably polyalkylene derivatives having a molecular weight of at least 400 such as those described in e.g. U.S. Pat. Nos. 3,038,805; 4,038,075, 4,292, 400 and 5,569,576 as well as in EP-A 0 634 688.

The photographic element of the present invention may further comprise various other additives such as e.g. compounds improving the dimensional stability of the photographic element, UV-absorbers and spacing agents.

Suitable additives for improving the dimensional stability of the photographic element are e.g. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, α-β-unsaturated dicarboxylic acids, hydroxyalkyl (meth)acrylates, sulfoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in RD No. 38957 (1996), Chapter VI, wherein also suitable optical brighteners are mentioned. UV-absorbers are especially useful in colour materials where they prevent fading by light of the colour images formed after processing.

Spacing agents can be present of which, in general, the average particle size is comprised between 0.2 and 10 $\mu$m. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophtha-late. Other suitable spacing agents have been described in U.S. Pat. No. 4,614,708.

The photographic material can contain several non-light sensitive layers, e.g. an antistress topcoat layer, one or more backing layers, and one or more intermediate layers eventually containing filter- or antihalation dyes that absorb scattering light and thus promote the image sharpness. Suitable light-absorbing dyes used in these intermediate layers are described in e.g. U.S. Pat. No. 4,092,168, U.S. Pat. No. 4,311,787, DE-A 2,453,217, and GB-Patent 7,907,440. Situated in such an intermediate layer between the emulsion layers and the support there will be only a small negligable loss in sensitivity but in rapid processing conditions decolouration of the filter dye layers may form a problem. Therefore it should be recommended to decrease the thickness of the whole coated layer packet resulting in shorter drying times after washing in the processing cycle. Alternatively the use of intermediate layers situated between emulsion layer(s) and support, reflecting the fluorescent light emitted by screens as used in radiographic applications may bring a solution with respect to high speed in rapid processing conditions. As the light emitted from the screens by the phosphors incorporated therein is a very important source of light-scattering the addition of appropriate filter dyes to the screens may be recommended. In the presence in the screens of e.g. green light-emitting phosphors use may be made of specific dyes as MAKROLEX ORANGE G or GG, trademarked products of BAYER AG.

One or more backing layers can be provided at the non-light sensitive side of the support of materials coated with at least one emulsion layer at only one side of the support. These layers which can serve as anti-curl layer can contain e.g. matting agents like silica particles, lubricants, antistatic agents, light absorbing dyes, opacifying agents, e.g. titanium oxide and the usual ingredients like hardeners and wetting agents.

The support of the photographic material may be opaque or transparent, e.g. a paper support or resin support. When a paper support is used preference is given to one coated at one or both sides with an $\alpha$-olefin polymer, e.g. a polyethylene layer which optionally contains an antihalation dye or pigment. It is also possible to use an organic resin support e.g. cellulose nitrate film, cellulose acetate film, poly(vinyl acetal) film, polystyrene film, poly(ethylene terephthalate) or poly(ethylene naphthalate) film, polycarbonate film, polyvinylchloride film or poly-$\alpha$-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide. A further survey of useful supports has been disclosed in RD 38957, Chapter 15.

The photographic material containing {100} tabular grains prepared according to the method of the present invention can be image-wise exposed by any convenient radiation source in accordance with its specific application.

Of course processing conditions and composition of processing solutions are dependent from the specific type of photographic material in which the {100} tabular grains rich in chloride prepared according to the present invention are applied. For example, in a preferred embodiment of materials for X-ray diagnostic purposes said materials may be adapted to rapid processing conditions in a developer containing hydroquinone as main developing agent or even free from hydroquinone: as a more ecological developing agent ascorbic acid, reductic acid or derivatives thereof may in part or integrally replace hydroquinone. Preferably an automatically operating processing apparatus is used provided with a system for automatic replenishment of the processing solutions.

For X-ray applications materials, the hydrophilic layers of which may have been forehardened e.g. by means of hardeners as set forth hereinbefore, may be processed using one-part package chemistry or three-part package chemistry, depending on the processing application determining the degree of hardening required in said processing cycle. Applications within total processing times of 30 seconds and lower up to 90 seconds, known as common praxis, are possible. From an ecological point of view it is e.g. possible to use sodium thiosulphate instead of ammonium thiosulphate.

The following examples illustrate the invention without however limiting it thereto.

EXAMPLES

Preparation of Emulsion A (comparative emulsion)

1450 ml of a dispersion medium (C) containing 97.5 g of essentially Ca-free gelatin was provided in a stirred reaction vessel. The pCl was adjusted with sodium chloride to a value of 2.0; pH was adjusted to a value of 5.7 and the reaction vessel was held at a constant temperature of 35° C.

While vigourously stirring this solution, a 2.94 molar solution of silver nitrate and a 2.94 molar solution of sodium chloride were added simultaneously in an amount of 100 ml within an addition time of 57 seconds by double jet precipitation, thus forming the nucleation step.

Into the said reaction vessel 1560 ml of a solution containing 435 mg of potassium iodide and 450 mg of sodium chloride was poured and the temperature of the mixture was raised to 65° C. over the next 20 minutes.

After 5 minutes the first growth step was started: during the next 7 minutes and 14 seconds the silver nitrate solution was run into the reaction vessel at a constant rate of 10 ml per minute, together with the sodium chloride solution, which was added at a variable addition rate in order to maintain a constant UAg of +178 mV vs.a silver/silver chloride reference electrode. During next 11 minutes and 53 seconds (at the end of which a temperature of 65° C. was reached) a further double jet precipitation was performed but the addition rate of silver nitrate was linearly increased from 10 to 15 ml/min. at the end of the first growth step, while maintaining UAg at a constant potential of +184 mV.

After a physical ripening time of 20 minutes a second growth step was started: sodium nitrate solution was added during 29 min. and 45 seconds at a linearly increasing rate from 11 ml/min. up to 35 ml/min. while maintaining UAg at a constant potential of +159 mV.

Preparation of Emulsion B (comparative emulsion)

The comparative emulsion B was prepared following the same preparation steps as for the comparative emulsion A hereinbefore, except for the addition of 1.175 g of copolymer TETRONIC 1508® from the start of the precipitation (thus adding the said copolymer before starting nucleation to the reaction vessel).

Preparation of Emulsion C (inventive emulsion)

The inventive emulsion C was prepared following the same preparation steps as for the comparative emulsion A hereinbefore, except for the addition of 1.175 g of copolymer TETRONIC 1508® after the first growth step.

From electron microscopic photographs (replicas) following emulsion crystal characteristics were measured:

- % TAB: procentual amount by number of tabular grains (=grains having an aspect ratio AR>5) in the whole grain population (=100%);
- % $T_{t<0.25\ \mu m}$: procentual amount by number of tabular grains having a thickness of less than 0.25 $\mu$m (all tabular grains=100%);
- % $T_{t>0.25\ \mu m}$: procentual amount by number of tabular grains having a thickness of more than 0.25 $\mu$m (all tabular grains=100%);
- % VAR: procentual variation on average grain size measured on the basis of electrochemical reduction at the highest sensitivity (trigger value $10^{-7}$), taking into account the smaller nuclei;
- % NUCL: numerical procentual amount of reduced grains having an equivalent volume diameter smaller than 0.03 $\mu$m (as determined by electrochemical reduction of said grains);
- average aspect ratio AAR, being defined as mean value obtained after calculating for each tabular grain having a thickness of less than 0.25 $\mu$m the ratio between equivalent circular diameter ECD and thickness t;
- ECD: equivalent circular diameter calculated as diameter of a circle having the same area as the projective surface of the corresponding tabular grain (values in Table 1 are the mean value calculated from all tubular {100} grains;
- % CUB: procentual amount by number of cubic crystals present;
- % N(eedles): procentual amount by number of needles present;
- % S(ingle)T(wins): procentual amount by number of crystals having a single twin.

TABLE 1

| Em. | % TAB | % VAR | % NUCL | % Tabs $T_{t<.25\mu m}$ | % Tabs $T_{t>.25\mu m}$ | AAR | ECD ($\mu$m) | % CUB | % N | % ST |
|---|---|---|---|---|---|---|---|---|---|---|
| A(comp) | 79 | 63 | 30 | 66 | 34 | 8.8 | 1.45 | 16 | 0.8 | 4.3 |
| B(comp) | 76 | 44 | 15 | 64 | 36 | 7.5 | 1.23 | 13 | 1.4 | 9.6 |
| C(inv.) | 79 | 57 | 23 | 77 | 23 | 7.7 | 1.24 | 15 | 0.7 | 5.6 |

As can be concluded from the data summarized hereinbefore in Table 1 a clearly enhanced procentual amount of {100} tabular silver halide grains rich in silver chloride having a thickness of less than 0.25 $\mu$m is present in the emulsion, when said emulsion has been prepared by the method of the present invention: addition of the trademarked copolymer product TETRONIC 1508 in a more early stage in the process makes renucleation (see % NUCL and % VAR) decrease as illustrated for the comparative Emulsion B, but this leads to a loss of tabular crystals in that more needles and single twins appear. Otherwise addition after the first growth step makes the procentual amount of {100} tabular grains having a thickness of more than 0.25 $\mu$m decrease with about ⅓ (33%) from about 34% to about 23% and changes the ratio between tabular grains thinner than 0.25 $\mu$m and tabular grains thicker than 0.25 $\mu$m from a value of less than 2:1 to a value of more than 3:1 (compare comparative Emulsion A and inventive Emulsion C). Procentual amounts of {100} tabular grains, cubic grains, single twins and needles present in the total grain population of the emulsions however remain about unchanged (79%: 15% : 5%: 1%).

Having described in detail preferred embodiments of the current invention, it will now be apparent to those skilled in the art that numerous modifications can be made therein without departing from the scope of the invention as defined in the following claims.

What is claimed is:

1. Method for preparing a light-sensitive silver halide photographic emulsion comprising performing at least three distinct precipitation steps in an aqueous medium in a reaction vessel, followed by desalting by means of flocculation and washing or by means of ultrafiltration, said emulsion comprising a colloidally stabilizing binder and {100} tabular silver halide grains containing at least 50 mole % of silver chloride, wherein at least 70% by number of all grains is provided by said tabular grains, exhibiting an average aspect ratio of at least 5 and an average equivalent circular grain diameter of at least 0.3 $\mu$m, wherein said tabular grains have an average thickness of less than 0.25 $\mu$m for at least 75% by number of all tabular grains;

said three distinct precipitation steps being a nucleation step, a first and a second growth step, said method being further characterized by introducing in the said reaction vessel after the first growth step a polyoxyalkylene block-copolymer according to the formula (I)

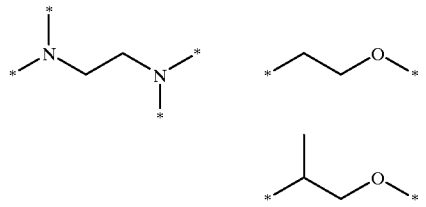

wherein said block-copolymer contains, besides an ethylenediamine unit as tetravalent linking unit, at least three terminal hydrophilic polyoxyethylene groups and not more than one terminal hydrophobic polyoxypropylene block unit.

2. Method according to claim 1, wherein introducing the block-copolymer in the reaction vessel proceeds before the second growth step.

3. Method according to claim 1, wherein said binder is a compound selected from the group consisting of gelatin, the block-copolymer corresponding to the formula (I) and colloidal silica or a combination thereof.

4. Method according to claim 3, wherein said gelatin has a methionine content of at most 4000 ppm.

5. Method according to claim 3, wherein said gelatin has a calcium content of less than 40 ppm.

6. Method according to claim 4, wherein said gelatin has a calcium content of less than 40 ppm.

7. Method according to claim 1, wherein said {100} tabular silver halide grains are composed of silver chloride, silver chlorobromide, silver chloroiodide or silver chlorobromoiodide and wherein in said silver chloroiodide or silver chlorobromoiodide silver iodide is present in an amount of from 0.05 mole % up to 3 mole %.

8. Method according to claim 1, wherein said tabular silver halide grains are containing at least 90 mole % of chloride.

9. Light-sensitive silver halide photographic emulsion comprising a colloidally stabilizing binder and {100} tabular silver halide grains containing at least 50 mole % of silver chloride, wherein at least
70% by number of all grains is provided by tabular grains, exhibiting an average aspect ratio of at least 5 and an average equivalent circular grain diameter of at least 0.3 $\mu$m, wherein said tabular grains have an average thickness of less than 0.25 $\mu$m for at least 75% by number of all tabular grains, said emulsion being prepared according to the method of claim 1.

10. Photographic material comprising a support and on at least one side of said support at least one light-sensitive silver halide emulsion layer, wherein said emulsion layer(s) comprise(s) one or more light-sensitive silver halide photographic emulsion(s) according to claim 9.

11. Photographic material according to claim 10, wherein said photographic material is a single or double side coated X-ray material.

12. Light-sensitive silver halide photographic emulsion comprising a colloidally stabilizing binder and {100} tabular silver halide grains containing at least 50 mole % of silver chloride, wherein at least
70% by number of all grains is provided by tabular grains, exhibiting an average aspect ratio of at least 5 and an average equivalent circular grain diameter of at least 0.3 $\mu$m, wherein said tabular grains have an average thickness of less than 0.25 $\mu$m for at least 75% by number of all tabular grains,
wherein said colloidally stabilizing binder comprises a polyoxyalkylene block-copolymer according to the formula (I)

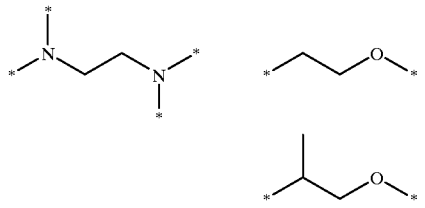

wherein said block-copolymer contains, besides an ethylenediamine unit as tetravalent linking unit, at least three terminal hydrophilic polyoxyethylene groups and not more than one terminal hydrophobic polyoxypropylene block unit.

13. Photographic material comprising a support and on at least one side of said support at least one light-sensitive silver halide emulsion layer, wherein said emulsion layer(s) comprise(s) one or more light-sensitive silver halide photographic emulsions according to claim 12.

14. Photographic material according to claim 13, wherein said photographic material is a single or double side coated X-ray material.

* * * * *